US007536148B2

(12) United States Patent
Fukumura

(10) Patent No.: US 7,536,148 B2
(45) Date of Patent: May 19, 2009

(54) IMAGE SCANNING DEVICE WITH A PIVOTABLE AUTOMATIC DOCUMENT FEEDER

(75) Inventor: Atsushi Fukumura, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 168 days.

(21) Appl. No.: 11/077,219

(22) Filed: Mar. 8, 2005

(65) Prior Publication Data

US 2005/0207810 A1 Sep. 22, 2005

(30) Foreign Application Priority Data

Mar. 19, 2004 (JP) ..... 2004-080068
Mar. 19, 2004 (JP) ..... 2004-081604

(51) Int. Cl.
*G03G 15/00* (2006.01)

(52) U.S. Cl. ..... 399/367; 399/380; 358/496; 400/691

(58) Field of Classification Search ..... 399/367, 399/380; 358/496; 400/691
See application file for complete search history.

(56) References Cited

U.S. PATENT DOCUMENTS 4,439,036 A * 3/1984 Davis et al. ..... 355/75
4,664,511 A * 5/1987 Carlson et al. ..... 355/91
5,060,019 A * 10/1991 Fukunaga ..... 399/380
5,110,103 A * 5/1992 Miyoshi et al. ..... 271/3.18
5,280,330 A * 1/1994 Baba ..... 399/370
5,666,595 A * 9/1997 Sameshima et al. ..... 399/110
5,878,319 A 3/1999 Itoh
6,128,455 A * 10/2000 Horiguchi et al. ..... 399/124
6,347,213 B1 * 2/2002 Yamanaka et al. ..... 399/367
6,408,161 B1 * 6/2002 Minowa et al. ..... 399/380
6,678,077 B1 * 1/2004 Huang ..... 358/497
2002/0051242 A1 * 5/2002 Han et al. ..... 358/474
2004/0218229 A1 * 11/2004 Chol ..... 358/474

FOREIGN PATENT DOCUMENTS

JP 03111833 A * 5/1991
JP 09-200400 7/1997
JP 09200400 A * 7/1997
JP 11-06086 4/1999
JP 11-106086 4/1999
JP 2002-185673 6/2002
JP 2002-218161 8/2002
JP 2002-374393 12/2002

* cited by examiner

*Primary Examiner*—Leslie J Evanisko
*Assistant Examiner*—Matthew G Marini
(74) *Attorney, Agent, or Firm*—Hogan & Hartson LLP

(57) ABSTRACT

In an image scanning device, an Automatic Document Feeder (ADF) frame accommodating an ADF is provided openable and closable on an upper surface of a device main body via a hinge member. In the hinge member, a frame supporting part fixed on one end part of the ADF frame and a base part fixed on the device main body are mounted in a manner capable of being swung. A rear side edge of the ADF frame is supported by the frame supporting part of the hinge member. The ADF frame is provided openable and closable so as to expose a bottom surface of the ADF frame to a front side.

13 Claims, 14 Drawing Sheets

IMAGE SCANNING DEVICE WITH A PIVOTABLE AUTOMATIC DOCUMENT FEEDER

CROSS-REFERENCE TO RELATED APPLICATIONS

This application claims priority under 35 USC 119 in Japanese Patent Application Nos. 2004-080068 and 2004-081604, both filed in the Japan Patent Office on Mar. 19, 2004, the entire disclosures of which are incorporated herein by reference.

BACKGROUND OF THE INVENTION

1. Field of the Invention

The present invention relates to an image scanning device in which an Automatic Document Feeder (ADF) frame accommodating an ADF is provided openable and closable on an upper surface of a device main body via a hinge member.

2. Description of Related Art

An image scanning device adopted in a scanner, a facsimile machine and a copying machine or the like uses a flat bed method and a sheet through method. According to the flat bed method, an original document is placed on a platen glass and an image scanning process is carried out. The flat bed method uses a Flat Bed Scanner (FBS). According to the sheet through method, a plurality of original documents are fed sequentially and an image scanning process is carried out. The sheet through method uses an ADF.

FIG. 13 is a schematic front view showing a conventional Plain Paper Facsimile (PPF) type image scanning device 100 which includes an ADF and carries out an image scanning process only by the sheet through method. The image scanning device 100 is primarily applied to a plain paper facsimile. As shown in the drawing, the image scanning device 100 includes a device main body 102 accommodating an image scanning unit 101 and an ADF frame 103 accommodating an ADF (not shown). Original documents P set on a document tray 104 are separated one sheet at a time from an uppermost sheet and fed into the ADF. An image on a front surface of the original documents P is scanned by the image scanning unit 101 through a slit glass 105 disposed at a scanning position X of the device main body 102. The scanned original documents P are discharged onto a document discharge tray 106.

As shown in FIG. 13, the device main body 102 includes a bottom frame 107 and a frame cover 108. The bottom frame 107 fixes the image scanning unit 101 below the ADF. The frame cover 108 is provided on an upper part of the bottom frame 107 and constitutes the document discharge tray 106 or the like. An insertion hole 109 is formed in a vertical direction at an end part of a side surface of the bottom frame 107. The ADF frame 103 is fixed on an upper surface of the device main body 102 via a hinge member 110 inserted in the insertion hole 109. Accordingly, the ADF frame 103 can be opened and closed in a lateral direction. The ADF frame 103 opened in the lateral direction is fixed at a position shown with a dashed line in the drawing by a lock mechanism (not shown). Under this state, a user carries out maintenance work such as the removal of jammed paper and cleaning of paper dust accumulated on the slit glass 105.

Meanwhile, FIG. 14 is a schematic perspective view showing a conventional Multi-Function Peripheral (MFP) type image scanning device 120 which includes a FBS and carries out an image scanning process by the flat bed method. The image scanning device 120 is applied to a MFP which includes multiple functions such as a facsimile function, a copy function, a scanner function and a printer function. As shown in the drawing, the image scanning device 120 includes a device main body 122 and a document pressing plate 123. A platen glass 121 is provided on an upper surface of the device main body 122. The document pressing plate 123 includes an ADF and is provided openable and closable on an upper surface of the device main body 122. The device main body 122 includes a hollow bottom frame 125 and a frame cover 126. An upper surface of the bottom frame 125 has an opening. The platen glass 121 is fixed on the frame cover 126. The frame cover 126 covers the upper surface of the bottom frame 125. An image scanning unit (not shown) is provided in the bottom frame 125 and carries out an image scanning process of an original document by moving below the platen glass 121. At a rear side edge of the frame cover 126 and the bottom frame 125, through holes and insertion holes for inserting hinge members 124 are formed, respectively. A rear side of the document pressing plate 123 is mounted on the upper surface of the device main body 122 via the hinge members 124 inserted through the through holes and the insertion holes. Accordingly, the document pressing plate 123 swings so as to release an upper side of the platen glass 121. As a result, an original document can be easily placed onto or removed from the platen glass 121.

The document pressing plate 123 includes the ADF. When an original document transported by the ADF passes over a slit glass 128 from an opening 127 formed on a lower surface of the document pressing plate 123, an image scanning process is carried out by the image scanning unit in the device main body 122. As described above, the document pressing plate 123 swings with the rear side as a swing center. Therefore, there are cases in which the opening 127, in other words, a transportation path, is displaced with respect to a scanning line of the image scanning unit located below the slit glass 128. Accordingly, an adjustment mechanism becomes necessary to correct the displacement. Conventionally, among a pair of hinge members 124 provided at the left and the right of the document pressing plate 123, for example, the left-side hinge member 124 is fixed and the right-side hinge member 124 is provided adjustable in a front-back direction of the image scanning device 120. By adjusting a position of the right-side hinge member 124, a position of the opening 127 of the document pressing plate 123 is adjusted with respect to the scanning line of the image scanning unit.

However, in the PPF type image scanning device 100, as shown in FIG. 13, the ADF frame 103 swings in the lateral direction of the device main body 102. Therefore, maintenance work of the image scanning device 100 is carried out from the right-hand side of the device main body 102. However, since the document tray 104 or the like is disposed at the right-hand side, there are drawbacks that clothes of a user like a cuff of a shirt may get caught and the maintenance work is difficult to be carried out. In addition, even when the user is left-handed, there are drawbacks that the user is required to carry out the maintenance work from the right-hand side and the maintenance work is difficult to be carried out.

Meanwhile, in case the ADF frame 103 is provided capable of swinging with the rear side of the image scanning device 100 as the swing center, in the same manner as the image scanning device 120, a position of the transportation path is required to be adjusted with respect to a position of the scanning line of the image scanning unit. However, unlike the document pressing cover 123 of the MFP type image scanning device 120, the ADF frame 103 does not have a sufficient width in the left-right direction. Thus, a pair of hinge members are difficult to be provided at the left and the right of the ADF frame 103 for adjusting the position of the ADF frame 103.

In the PPF type image scanning device 100, the insertion hole 109 is provided at the end part of the side surface of the bottom frame 107 and the image scanning unit 101 is fixed at the scanning position X of the device main body 102. On the contrary, in the MFP type image scanning device 120, the insertion holes are provided at the rear side edge of the bottom frame 125 and the image scanning unit is provided movable in the device main body 122. Therefore, in the image scanning device 100 and the image scanning device 120, since a structure and a function of the bottom frame 107 and the bottom frame 125 are different from one another, the bottom frame 107 and the bottom frame 125 are designed and manufactured separately.

SUMMARY OF THE INVENTION

The present invention has been made in consideration of the above-described drawbacks. An advantage of the present invention is to facilitate maintenance work carried out in an image scanning device in which an ADF frame accommodating an ADF is provided openable and closable on an upper surface of a device main body and an image scanning process is carried out by a sheet through method.

Another advantage of the present invention is to reduce costs by standardizing a bottom frame of the device main body for a PPF type and a MFP type.

Another advantage of the present invention is to enable a position of the ADF frame to be adjusted with respect to a position of a scanning line of an image scanning unit.

According to an aspect of the present invention, in an image scanning device which carries out an image scanning process by a sheet through method, an ADF frame accommodating an ADF is provided openable and closable on an upper surface of a device main body having an image scanning unit via a hinge member. Further, the ADF transports an original document from a document tray via a scanning position of the device main body to a document discharge tray. A rear side of the ADF frame is supported by the hinge member. The ADF frame is provided openable and closable so as to expose a bottom surface of the ADF frame to a front side.

According to an aspect of the present invention, the device main body includes a bottom frame formed as a hollow housing having an opening at an upper part, and a frame cover which covers the upper part of the bottom frame. A supporting part is provided on the bottom frame and the hinge member or another hinge member can be inserted selectively in the supporting part. Further, the other hinge member is a hinge member which, in case of using the bottom frame in an image scanning device which carries out an image scanning process by a flat bed method, supports a document pressing plate to be openable and closable on the upper surface of the device main body.

According to an aspect of the present invention, the hinge member includes a frame supporting part and a base part which are mounted in a manner capable of swinging. The frame supporting part is fixed on one end part of the ADF frame. The base part is fixed on the device main body. At least three protrusions are provided on the ADF frame. The protrusions make contact with the upper surface of the device main body and carries out a positioning of the ADF frame. In addition, the base part of the hinge member is mounted on the upper surface of the device main body in a manner capable of moving vertically within a prescribed range.

According to the aspect of the present invention, the rear side of the ADF frame accommodating the ADF is supported by the hinge member and the ADF frame is provided openable and closable so at to expose the bottom surface of the ADF frame to the front side. Therefore, when carrying out the maintenance work of the image scanning device, clothes of the user are not caught in the document tray or the like. In addition, the maintenance work can be carried out easily regardless of a dominant hand of the user. Furthermore, since the document tray and the document discharge tray are provided separately with respect to the ADF frame, a member to be supported by the hinge member can be limited and a structure of a positioning mechanism can be simplified. In addition, a removal of an original document jammed in the transportation path of the ADF and other maintenance works can be carried out easily, and the structure of the ADF can be simplified.

According to the aspect of the present invention, the bottom frame of the device main body is provided with the supporting part in which the hinge member or another hinge member, which in case of using the bottom frame in the image scanning device which carries out an image scanning process by the flat bed method, supports the document pressing plate to be openable and closable on the upper surface of the device main body, can be inserted selectively. Therefore, the bottom frame can be standardized for the PPF type image scanning device and the MFP type image scanning device. As a result, the costs can be reduced.

According to the aspect of the present invention, the ADF frame is provided with at least three protrusions which makes contact with the upper surface of the device main body and carries out a positioning of the ADF frame. In addition, the base part of the hinge member is mounted on the upper surface of the device main body in a manner capable of moving vertically within a prescribed range. Therefore, the position of the ADF frame with respect to the scanning line of the image scanning unit can be adjusted.

DETAILED DESCRIPTION OF THE INVENTION

Figure 1:
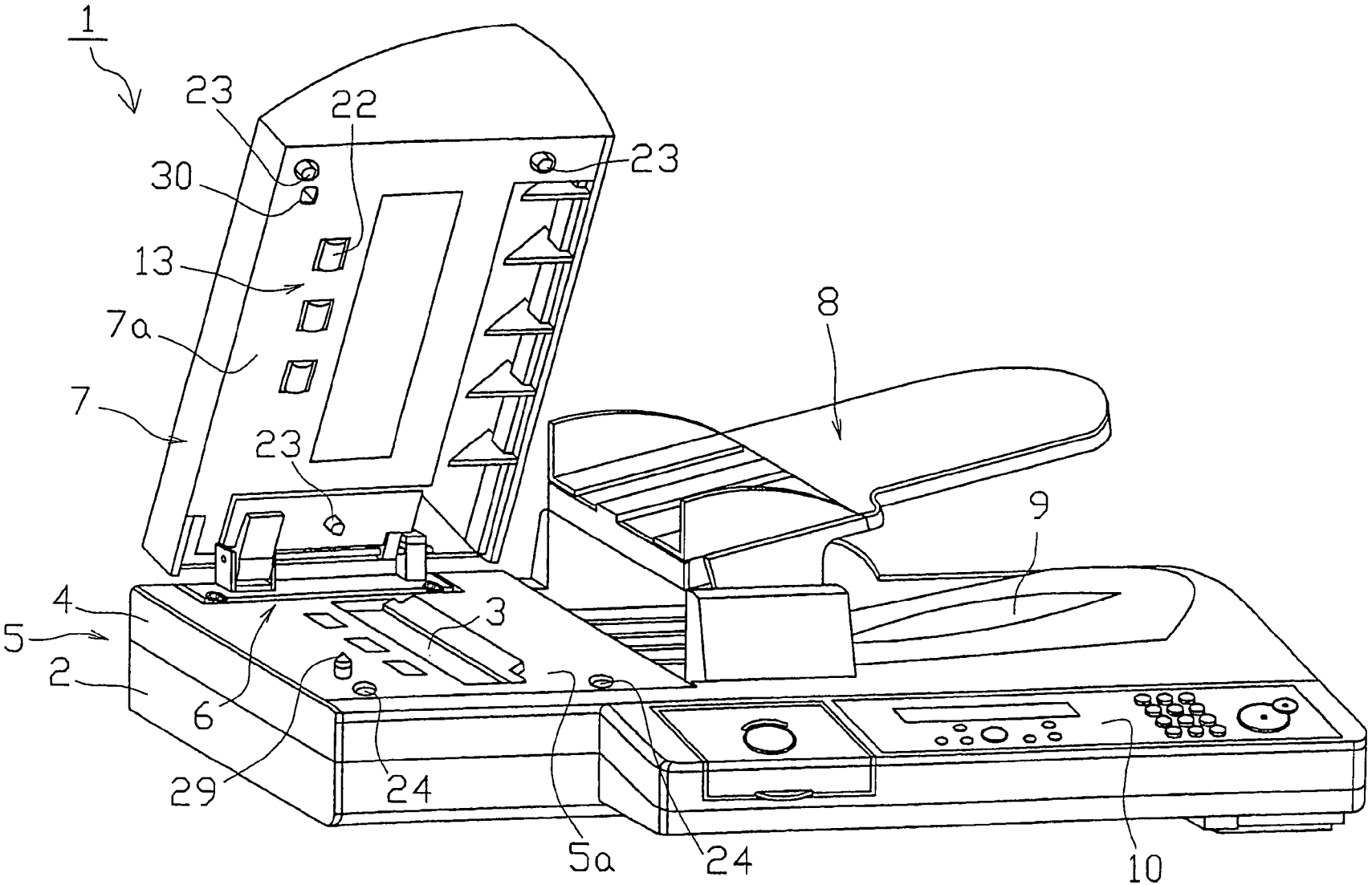
FIG. 1 is a schematic perspective view showing an exterior of an image scanning device according to an embodiment of the present invention.

With reference to the drawings, an image scanning device 1 according to an embodiment of the present invention will be described. The image scanning device 1 is a PPF type image scanning device which includes an ADF and carries out an image scanning process by a sheet through method. FIG. 1 is a schematic perspective view showing an exterior of the image scanning device 1. As shown in FIG. 1, the image scanning device 1 includes a device main body 5, an ADF frame 7, a document tray 8, a document discharge tray 9 and an operation panel 10. The device main body 5 includes a bottom frame 2 and a frame cover 4. The bottom frame 2 is formed as a hollow housing having an opening at an upper part. A slit glass 3 is disposed on an upper surface of the frame cover 4. The frame cover 4 covers the upper part of the bottom frame 2. The ADF frame 7 is provided openable and closable on an upper surface 5*a* of the device main body 5 via a hinge member 6. An original document P to be scanned is placed on the document tray 8. The document discharge tray 9 receives a scanned original document P. The operation panel 10 is provided on a front side of the device main body 5 for operating the image scanning device 1.

Figure 2:
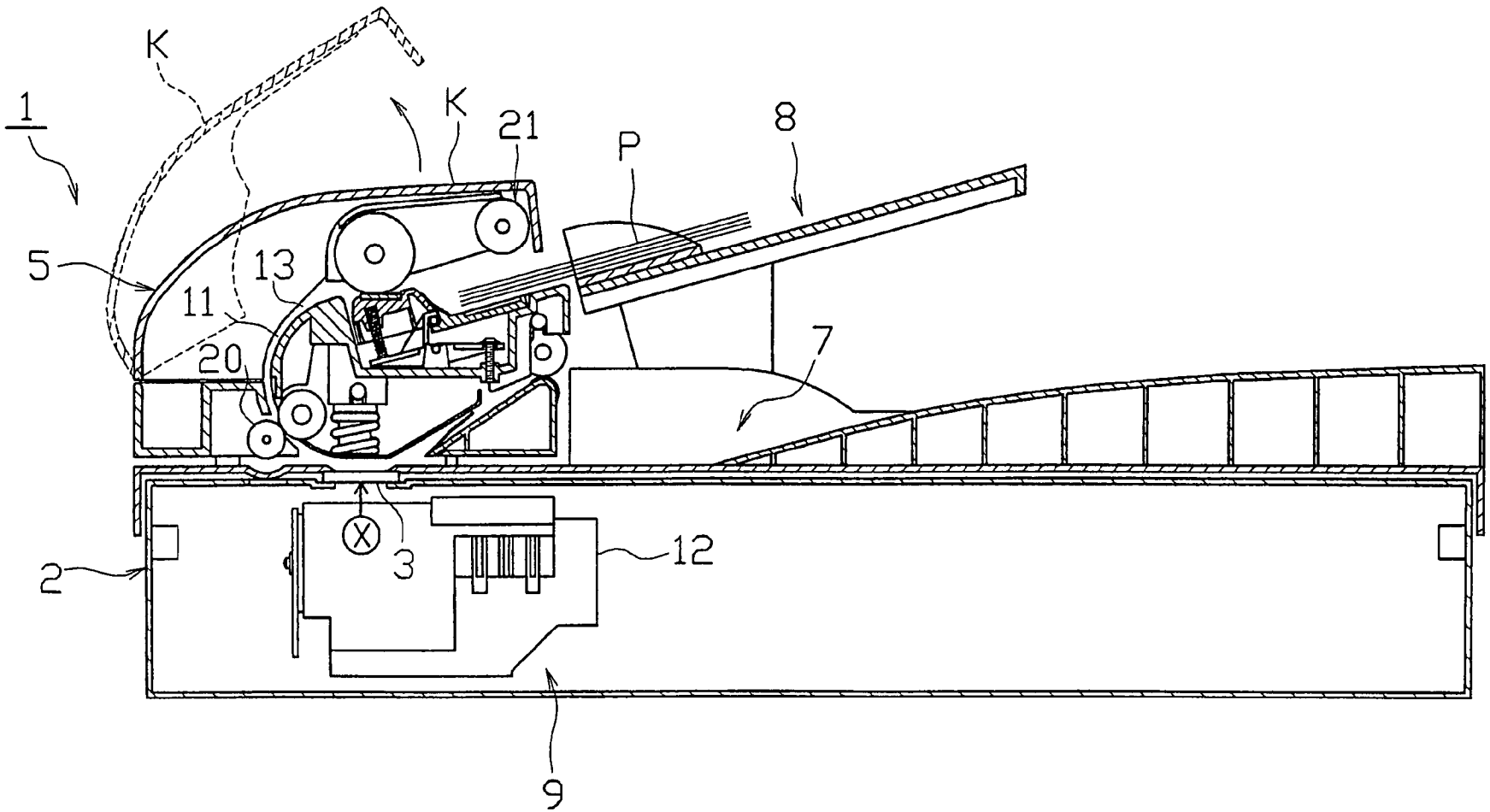
FIG. 2 is a schematic vertical cross-sectional view showing an inner structure of the image scanning device according to an embodiment of the present invention.

FIG. 2 is a schematic vertical cross-sectional view showing an inner structure of the image scanning device 1. As shown in the drawing, in the image scanning device 1, an ADF 11 is accommodated in the ADF frame 7 and a scanner unit (an image scanning unit) 12 is accommodated in the device main body 5. A plurality of original documents P are stacked on the document tray 8 with a front surface of the original documents P facing upward. The original documents P are separated and fed into a transportation path 13 one sheet at a time from an uppermost sheet. When the original document P passes a scanning position X, an image on the front surface of the original document P is scanned by the scanner unit 12. The scanned original document P is discharged onto the document discharge tray 9.

Figure 3:
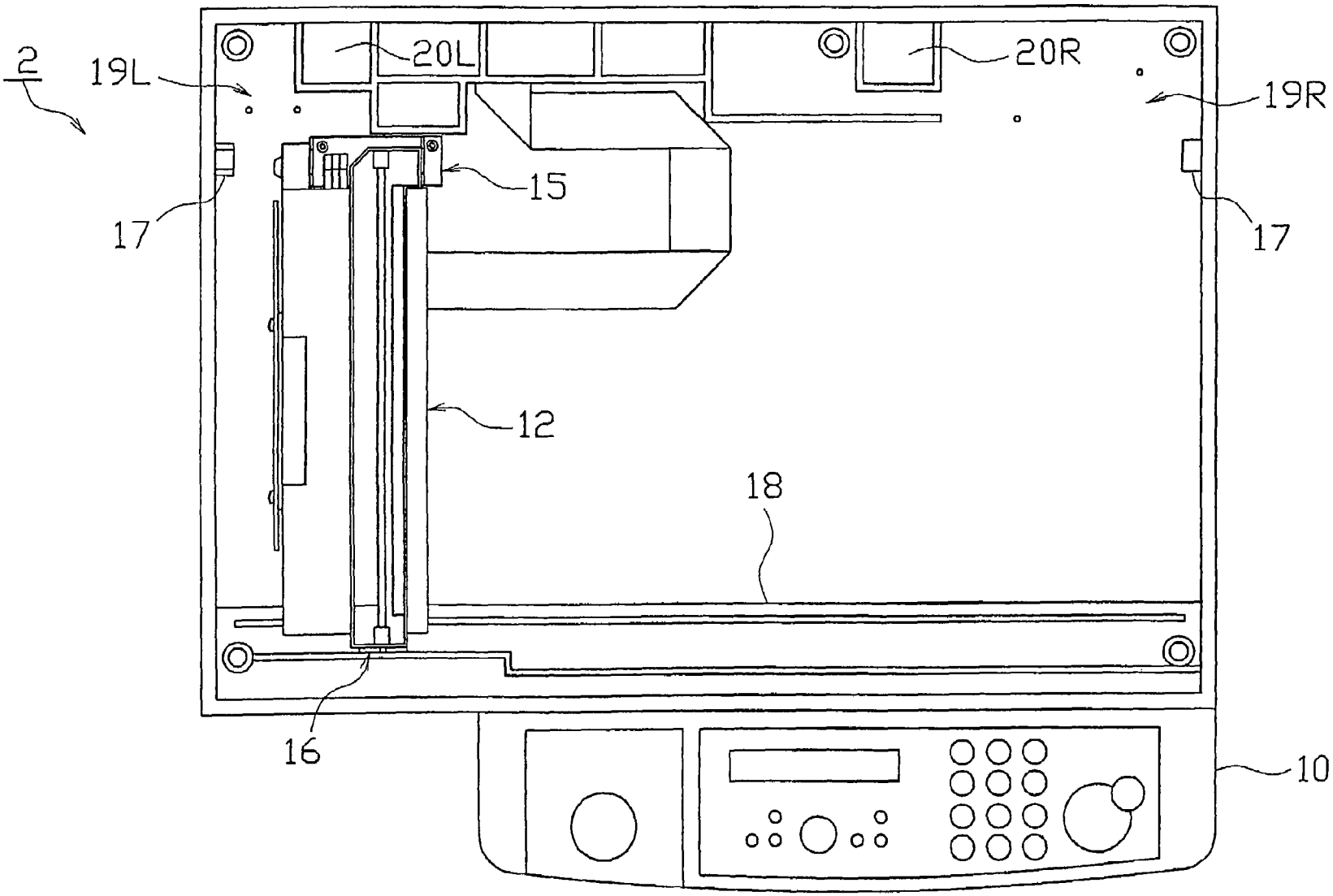
FIG. 3 is a schematic plan view showing an inner structure of a bottom frame according to an embodiment of the present invention.

The scanner unit 12 is a Charge Coupled Device (CCD) scanning unit of a reduced optical system which carries out an image scanning process by irradiating light onto the original document P through the slit glass 3 and converting reflected light from the original document P into an electric signal. Although details are not shown in the drawing, an approximately rectangular parallelepiped housing 14 of the scanner unit 12 includes a light source, a reflecting mirror, a condenser lens and a CCD image sensor. FIG. 3 is a schematic plan view showing an inner structure of the bottom frame 2. As shown in the drawings, the scanner unit 12 is fixed directly below the scanning position X in the bottom frame 2. One end of the scanner unit 12 is fixed by a first holding member 15. Another end of the scanner unit 12 is fixed by a second holding member 16. To enable the bottom frame 2 to be used in an image scanning device which includes a FBS and carries out an image scanning process by a flat bed method, as shown in FIG. 3, the bottom frame 2 is provided with guide rod fixing parts 17, a guide rail 18, belt driving mechanism mounting parts 19L and 19R and insertion holes (supporting parts) 20L and 20R.

As shown in FIG. 3, the insertion hole 20L is a space surrounded by a frame made of a resin or the like located at a left corner in the rear side of the bottom frame 2. A transverse cross-sectional shape of the insertion hole 20L is approximately rectangular. A depth measurement of the insertion hole 20L is approximately the same as a height measurement of the bottom frame 2. The insertion hole 20L is shared by the PPF type image scanning device 1 which carries out an image scanning process by the sheet through method and a MFP type image scanning device which includes a FBS and carries out an image scanning process by the flat bed method. That is, in case of using the bottom frame 2 in the image scanning device 1, one end part of the hinge member 6 that supports the ADF frame 7 is inserted in the insertion hole 20L and the hinge member 6 is positioned with respect to the device main body 5. In case of using the bottom frame 2 in the image scanning device having the FBS, one end part of a hinge member that supports a document pressing plate is inserted in the insertion hole 20L and the hinge member is positioned with respect to the device main body. Meanwhile, as shown in FIG. 3, the insertion hole 20R having the same structure as the insertion hole 20L is provided at a position located to the right of a center part in the rear side of the bottom frame 2. The insertion hole 20R is provided assuming a case in which the bottom frame 2 is used for the image scanning device having the FBS. That is, considering that in the image scanning device having the FBS, the document pressing plate is generally supported by hinge members at two positions in the rear side of the image scanning device, one of the hinge members is inserted into the insertion hole 20L and another one of the hinge members is inserted into the insertion hole 20R. Therefore, in case of using the bottom frame 2 in the image scanning device 1, the insertion hole 20R is not used. The structure of the guide rod fixing parts 17, the guide rail 18 and the belt driving mechanism mounting parts 19L and 19R will be described later in a description of an image scanning device 50 and a detailed description will be omitted here.

The ADF frame 7 is a resin-made frame which is formed as a hollow housing. The ADF 11 can be accommodated in the ADF frame 7. As shown in FIG. 1 and FIG. 2, the ADF 11 includes the transportation path 13 having an approximately sideways letter-U shape, a paper feed unit 21 and a transportation roller 22. The transportation path 13 connects the document tray 8 and the document discharge tray 9. The paper feed unit 21 separates an uppermost sheet from a bundle of original documents P and feeds an original document P into the transportation path 13. The transportation roller 22 is disposed appropriately along the transportation path 13 and transports the original document P toward a downstream side.

As shown in FIG. 1, the end part of the rear side of the ADF frame 7 is mounted on the upper surface 5*a* of the device main body 5 via the hinge member 6. The ADF frame 7 is provided openable and closable so as to be opened forward, in other words, in a manner that a bottom surface 7*a* of the ADF frame 7 is exposed to the front side of the device main body 5. The ADF frame 7 is provided in the above-described manner so that when an original document P is jammed in the ADF 11, the ADF frame 7 can be opened to expose the transportation path 13 and the jammed original document P can be removed easily. In addition, when carrying out maintenance work of the image scanning device 1, the ADF frame 7 can be opened to enable the maintenance work to be carried out easily. Further, as shown in FIG. 2, by opening only an upper cover K of the ADF frame 7 upward and exposing the transportation path 13, the original document P jammed inside the ADF frame 7 can be removed.

Since the ADF frame 7 is provided openable and closable as described above, the ADF frame 7 is necessary to be positioned at a given position with respect to the device main body 5 so that when closing the opened ADF frame 7, the ADF frame 7 does not slat or a leading end of the ADF frame 7 is not lifted to cause a skew of the original document P or a deterioration in an image quality of an image scanned by the scanner unit 12. Therefore, in the present embodiment, as shown in FIG. 1, a pair of left and right protrusions 23 protruding from the bottom surface 7*a* are provided at the leading end side of the ADF frame 7, in other words, at an end part of the ADF frame 7 located opposite to the side of the hinge member 6. In addition, for each of the protrusions 23, two concaves 24 are formed on the upper surface 5*a* of the device main body 5. The protruding length of each of the protrusions 23 from the bottom surface 7*a* of the ADF frame 7 are the same with respect to one another. Furthermore, as shown in FIG. 1, a protrusion 23 is also provided at an approximately center part at a base end side of the ADF frame 7, in other words, at the side where the ADF frame is mounted by the hinge member 6. The protruding length of this protrusion 23 from the bottom surface 7*a* of the ADF frame 7 is the same as the protruding length of each of the protrusions 23 at the leading end side. Accordingly, by closing the ADF frame 7 so that all of the three protrusions 23 at the leading end side and the base end side make contact with the upper surface 5*a* of the device main body 5, the ADF frame 7 can be maintained horizontally at a prescribed height. The protrusions 23, which carry out the positioning of the ADF frame 7 in a height direction as described above, can be provided at three positions or more on the bottom surface 7*a* of the ADF frame 7. However, at least three positions are sufficient to be provided for positioning the ADF frame 7 horizontally. From an aspect of a cost reduction, three protrusions are preferable. The position of each of the protrusions 23 is not limited to the present embodiment and can be changed appropriately if the three protrusions 23 are not arranged in a straight line. However, to stably hold the ADF frame 7, as in the present embodiment, two protrusions are preferable to be provided at both end parts of the leading end side of the ADF frame 7 and one protrusion is preferable to be provided at one position in the center part of the base end side of the ADF frame 7.

Further, one of the two protrusions 23 at the leading end side is formed with a magnet, and a steel plate is disposed on a bottom part of one of the concaves 24 associated with the magnet protrusion 23. Accordingly, when closing the ADF frame 7, one of the protrusions 23 adheres to the bottom part of one of the concaves 24 by a magnetic force. The opening and the closing of the ADF frame 7 are detected by an open-close detection sensor (not shown) accommodated in the ADF frame 7 which detects an electric current that flows between one of the protrusions 23 and one of the concaves 24.

Figure 4:
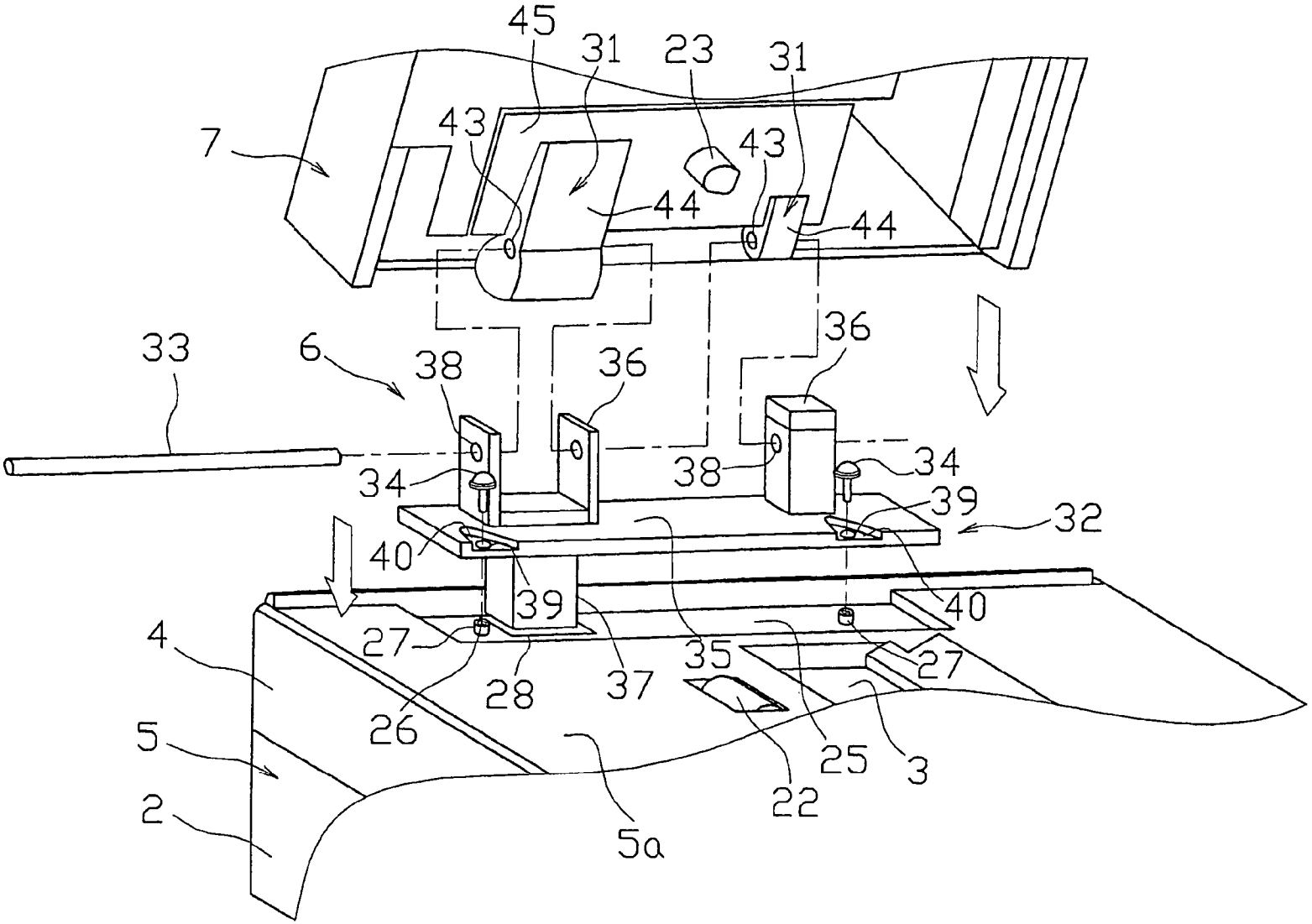
FIG. 4 is an enlarged exploded perspective view in proximity to one of the hinge members of FIG. 1 according to an embodiment of the present invention.

FIG. 4 is an enlarged exploded perspective view in proximity to the hinge member 6 of FIG. 1. As shown in FIG. 1 and FIG. 4, on the upper surface 5*a* of the device main body 5, a mounting concave 25, a pair of left and right bosses 27, a through hole 28 and a positioning pin 29 are respectively provided at a part corresponding to the ADF frame 7. The mounting concave 25 is provided for mounting the hinge member 6. The bosses 27 protrude from a bottom part of the mounting concave 25. A screw hole 26 is formed in each of the bosses 27, respectively. The through hole 28 is formed on the bottom part of the mounting concave 25 for inserting one end part of the hinge member 6 into the device main body 5. The positioning pin 29 positions the ADF frame 7 with respect to the device main body 5 in the horizontal direction.

Figure 5:
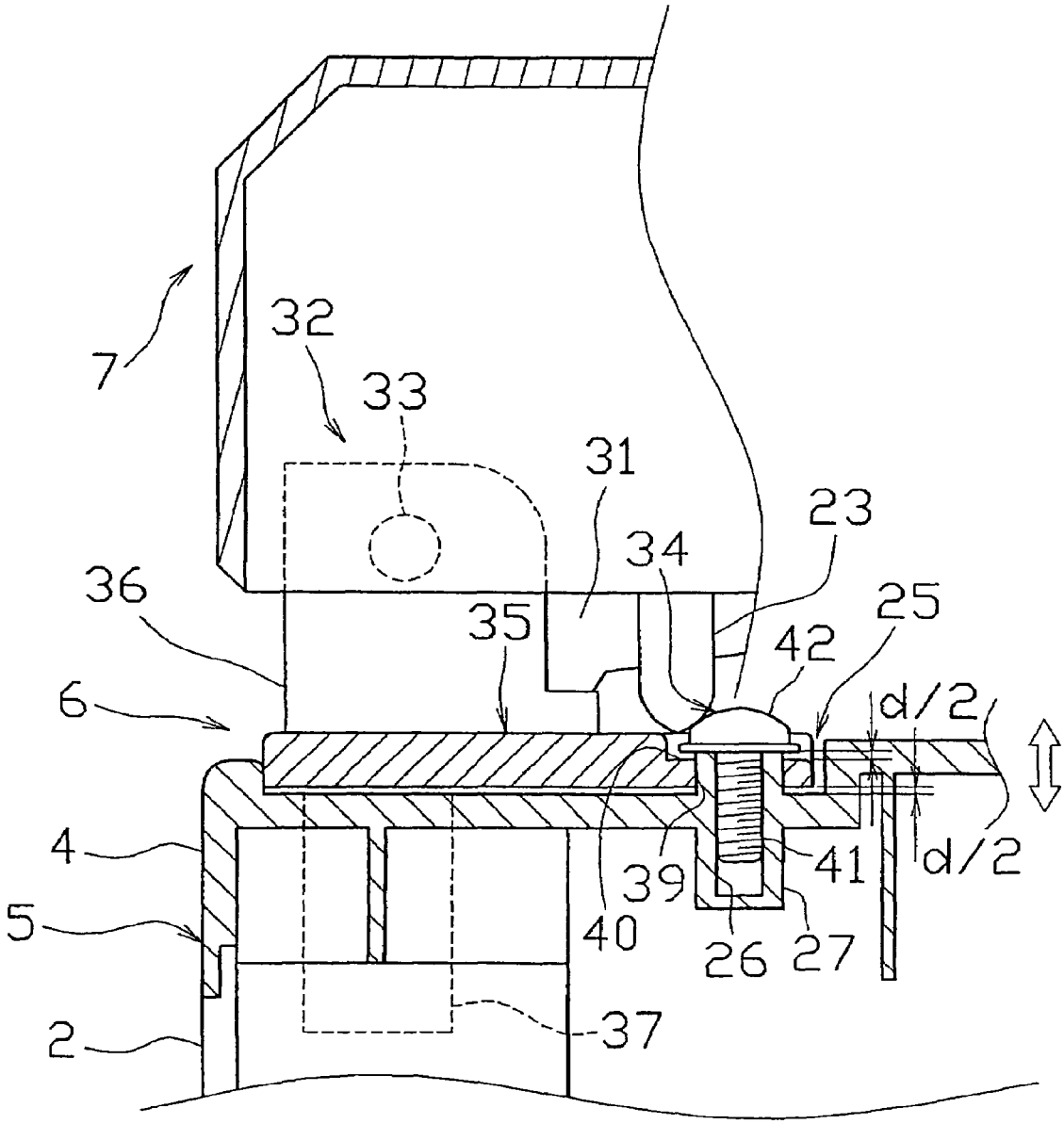
FIG. 5 is a schematic vertical cross-sectional view showing a state in which an ADF frame is closed viewed from a side of the image scanning device according to an embodiment of the present invention.

As shown in FIG. 4, the mounting concave 25 is formed at the rear side edge on the upper surface of the frame cover 4 for mounting the hinge member 6 onto the upper surface 5*a* of the device main body 5 so as to form a substantially even surface. The mounting concave 25 is approximately rectangular in a plan view. The bosses 27 are inserted to the hinge member 6 and position the hinge member 6 with respect to the device main body 5. Regulatory screws 34 to be described later are screwed together with the bosses 27. As shown in FIG. 4 and FIG. 5, the bosses 27 are approximately cylindrical. The bosses 27 protrude from two positions on the bottom part of the mounting concave 25. A lower end of the bosses 27 is formed protruding inward to the device main body 5. The protruding heights of the bosses 27 from the upper surface of the frame cover 4 are approximately the same or slightly smaller than the depth measurement of the mounting concave 25. The through hole 28 is formed through the frame cover 4 for positioning the hinge member 6 by inserting one end part of the hinge member 6 into the device main body 5. The through hole 28 is formed at a position corresponding to the insertion hole 20L of the bottom frame 2. The shape of the through hole 28 in a plan view is approximately the same as the shape of the insertion hole 20L. Accordingly, the hinge member 6 is inserted through the through hole 28 and into the insertion hole 20L.

The positioning pin 29 is provided for preventing the ADF frame 7 from being displaced in the horizontal direction with respect to the device main body 5 under a state in which the ADF frame 7 is closed. That is, according to an embodiment of the present invention, the position of the ADF frame 7 is not fixed with respect to the device main body 5. In addition, since the rear side edge of the ADF frame 7 is mounted on the upper surface 5*a* of the device main body 5 so that the ADF frame 7 opens forward, a swing radius of the ADF frame 7 having the hinge member 6 as a swing center becomes long and the ADF frame 7 is prone to be displaced in the horizontal direction. Therefore, the positioning pin 29 is provided protruding from the upper surface 5*a* of the device main body 5 at an inner position with respect to the concave 24, and a positioning hole 30 shaped to be fit with the positioning pin 29 is formed on the bottom surface 7*a* of the ADF frame 7. Accordingly, when the ADF frame 7 is closed, the positioning pin 29 fits into the positioning hole 30 and the ADF frame 7 is held incapable of moving in the horizontal direction. Further, the position and the number of the positioning pin 29 and the positioning hole 30 can be changed. However, as in the present embodiment, if the positioning pin 29 and the positioning hole 30 are provided at a position located away from the mounted position of the ADF frame 7 on the device main body 5, the ADF frame 7 can be held more reliably and thus preferable.

As shown in FIG. 4, the hinge member 6 includes a pair of left and right frame supporting parts 31 and a base part 32 which are mounted via a hinge pin 33 in a manner capable of swinging. The frame supporting parts 31 support one end part of the ADF frame 7. The base part 32 is mounted onto the device main body 5. The base part 32 of the hinge member 6 is mounted onto the upper surface 5*a* of the device main body 5 via the regulatory screws (fixing tools) 34 in a manner capable of moving vertically within a prescribed range.

As shown in FIG. 4, the base part 32 includes a mounting plate 35, a pair of left and right hinge pin supporting portions 36 and an insertion portion 37. The mounting plate 35 is mounted onto the upper surface of the frame cover 4. The hinge pin supporting portions 36 protrude upward from an upper surface of the mounting plate 35 and support both end parts of the hinge pin 33, respectively. The insertion portion 37 protrudes downward from a bottom surface of the mounting plate 35 and is inserted into the device main body 5. In each of the hinge pin supporting portions 36, a pin insertion hole 38 is respectively formed for inserting the hinge pin 33. The long hinge pin 33 is inserted through each of the pin insertion holes 38 and fixed. Accordingly, the hinge pin 33 is provided hanging across the left and the right hinge pin supporting portions 36. The insertion portion 37 is inserted through the through hole 28 of the frame cover 4 and into the insertion hole 20L of the bottom frame 2. Accordingly, the hinge member 6 is positioned with respect to the device main body 5. The shape of the insertion portion 37 in the transverse cross-section is formed slightly smaller than the through hole 28 and the insertion hole 20L. When the insertion portion 37 is inserted into the insertion hole 20L, a slight gap is generated between the insertion portion 37 and the insertion hole 20L. Accordingly, the hinge member 6 is allowed to rattle in the gap.

As shown in FIG. 4, the mounting plate 35 is a flat plate which is approximately rectangular in a plan view. The mounting plate 35 includes boss insertion holes 39 and leveled-down parts 40. In each of the boss insertion holes 39, each of the bosses 27 is inserted. Each of the leveled-down parts 40 is formed around each of the boss insertion holes 39 by being leveled down from the upper surface of the mounting plate 35. The planar shape of the mounting plate 35 is slightly smaller than the planar shape of the mounting concave 25. The thickness measurement of the mounting plate 35 is approximately the same as the depth measurement of the mounting concave 25. By fitting and mounting the mounting plate 35 onto the mounting concave 25, the mounting plate 35 is prevented from being displaced in the horizontal direction. The thickness measurement of the mounting plate 35 at the leveled-down parts 40 is slightly smaller than the protruding height of each of the bosses 27 protruding from the bottom part of the mounting concave 25. Accordingly, as shown in FIG. 5, when each of the bosses 27 is inserted into each of the boss insertion holes 39, an upper end surface of each of the bosses 27 protrudes from an upper surface of the leveled-down parts 40. Although details are not shown in the drawing, a diameter of each of the boss insertion holes 39 is formed slightly larger than an outer diameter of each of the bosses 27. Therefore, when the bosses 27 are inserted into the boss insertion holes 39, a slight gap is generated between an inner circumferential surface of the boss insertion holes 39 and an outer circumferential surface of the bosses 27. Accordingly, the hinge member 6 is allowed to rattle slightly in the horizontal direction in the gap.

As shown in FIG. 5, a difference d is provided between the upper end surface of the bosses 27 and the upper surface of the mounting plate 35. Accordingly, under a state in which each of the bosses 27 is inserted into each of the boss insertion holes 39, the leveled-down parts 40 allow the mounting plate 35 to move vertically along each of the bosses 27 for the difference d. To provide the difference d between the upper end surface of the bosses 27 and the upper surface of the mounting plate 35, other than forming a leveled-down part on the upper surface of the mounting plate 35 as in the present embodiment, a position of the upper end surface of the bosses 27 can be raised. That is, without forming the leveled-down part 40, the protruding height of each of the bosses 27 protruding from the bottom part of the mounting concave 25 can be made larger than the thickness of the mounting plate 35 to provide the difference d between the upper end surface of the bosses 27 and the upper surface of the mounting plate 35.

The regulatory screw 34 determines an uppermost position of the mounting plate 35 in the vertical movement. As shown in FIG. 5, the regulatory screw 34 includes a screw portion 41 and a screw head 42. The screw portion 41 is shorter than the depth of the screw hole 26 of the boss 27. The diameter of a lower end part of the screw head 42 is formed larger than the diameter of the boss 27. Until the lower end part of the screw head 42 makes contact with the upper end surface of the boss 27, the regulatory screw 34 is screwed together with the screw hole 26 of the boss 27. The lower end part of the screw head 42 protrudes like a brim from the upper end surface of the boss 27. When the mounting plate 35 makes contact with the lower end part of the screw head 42 protruding like a brim, the mounting plate 35 is prevented from moving further upward. The moving range of the mounting plate 35 can be increased by turning the regulatory screws 34 and increasing the protruding length of the regulatory screws 34 from the bosses 27. On the contrary, the moving range of the moving plate 35 can be reduced by turning the regulatory screws 34 and shortening the protruding length of the regulatory screws 34 from the bosses 27.

As described above, the hinge member 6 is mounted on the upper surface 5*a* of the device main body 5 in a manner that the hinge member 6 can move vertically within a prescribed range. Accordingly, a slight rattling is allowed at the mounted side of the ADF frame 7. Therefore, even in case an error is generated in the measurement or the mounting of the hinge member 6, the ADF frame 7 or the device main body 5, when closing the ADF frame 7, the mounting plate 35 moves vertically according to the error. As a result, each of the protrusions 23 of the ADF frame 7 reliably makes contact with the upper surface 5*a* of the device main body 5 and the ADF frame 7 can be closed horizontally. Accordingly, the original document P can be scanned accurately by the scanner unit 12.

As shown in FIG. 4, the frame supporting parts 31 include a pair of left and right arm members 44 and a fixing plate 45. A pin insertion hole 43 is respectively formed through a circular base end of the arm members 44 for inserting through the hinge pin 33. The fixing plate 45 is connected to a leading edge of each of the arm members 44. The fixing plate 45 is fixed on the ADF frame 7 with a screw or the like. In addition, the hinge pin 33 is inserted through the pin insertion hole 43 of each of the arm members 44, respectively. Accordingly, the ADF frame 7 can be swung with the hinge pin 33 as the swing center. Moreover, as described above, the protrusion 23 is provided at approximately the center part of the fixing plate 45 for maintaining the ADF frame 7 at a prescribed height from the upper surface 5*a* of the device main body 5 by making contact with the upper surface of the mounting plate 35.

Figure 6:
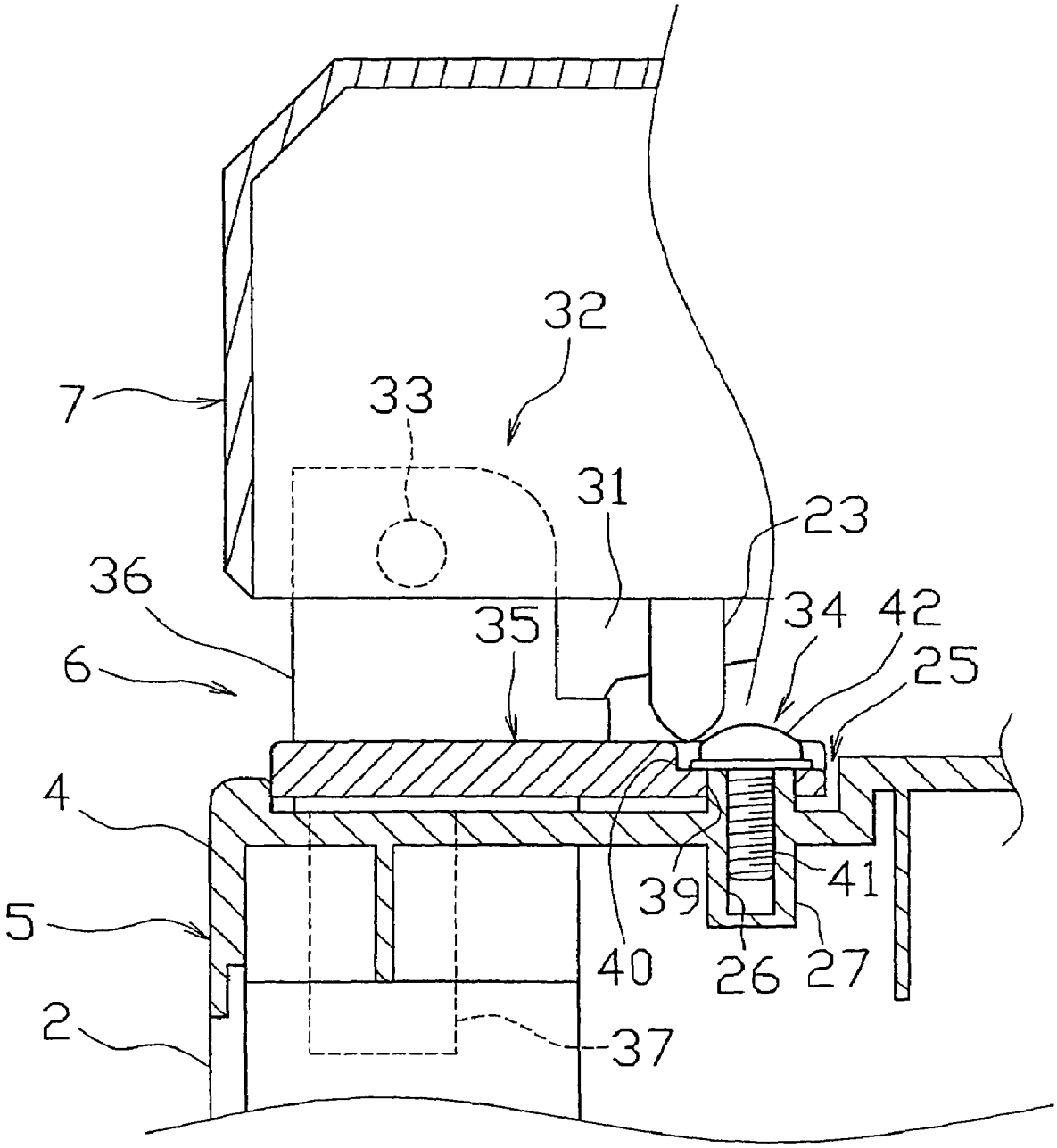
FIG. 6 is a schematic vertical cross-sectional view showing a state in which the ADF frame is closed in case an error is generated in the hinge member or the like viewed from the side of the image scanning device according to an embodiment of the present invention.
Figure 7:
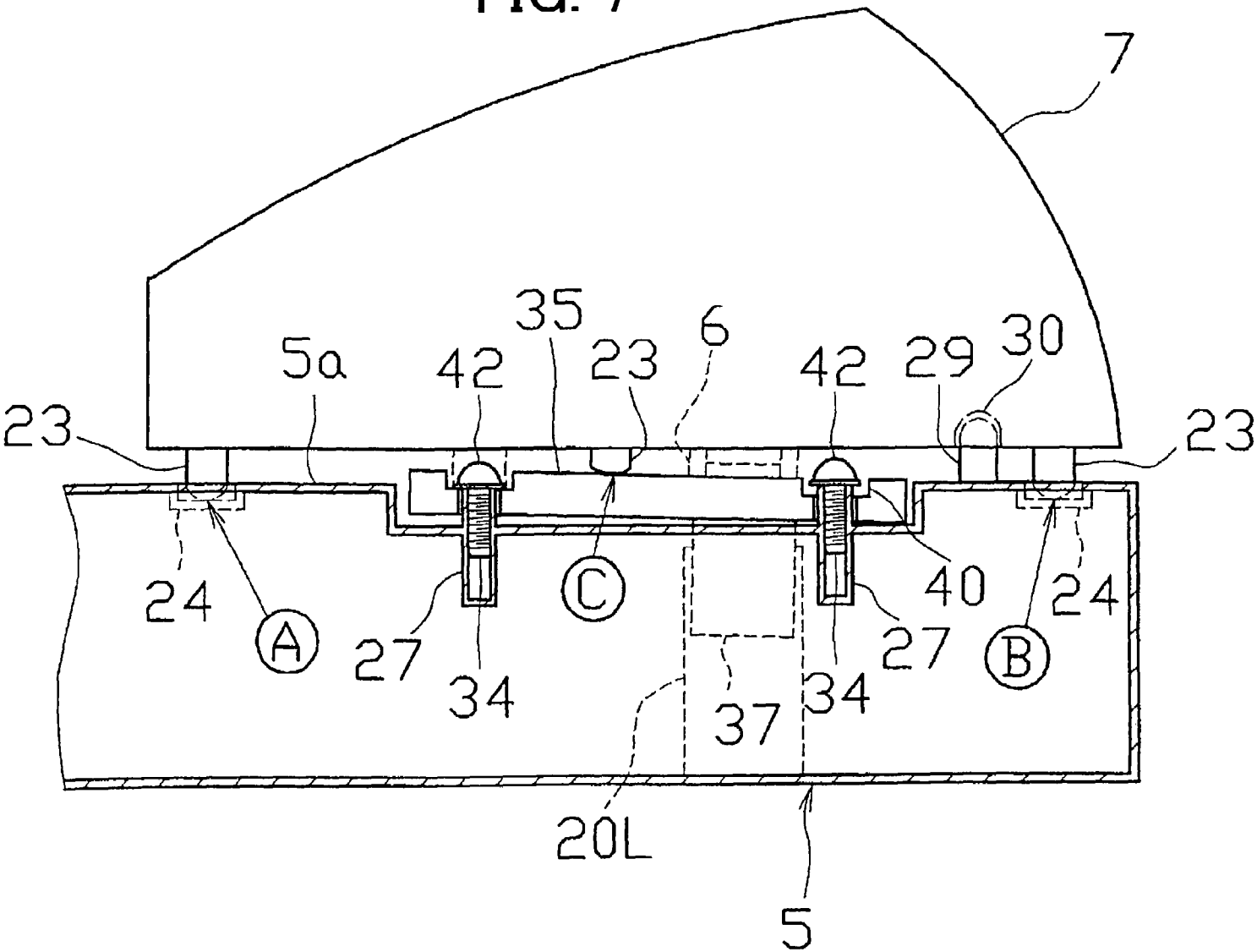
FIG. 7 is a schematic vertical cross-sectional view showing a state in which the ADF frame is closed in case an error is generated in the hinge member or the like viewed from a rear side of the image scanning device according to an embodiment of the present invention.

In the following, a description will be made of the vertical movement of the hinge member 6 in case an error is generated in the measurement or the mounting of the hinge member 6 or the like. FIG. 5 through FIG. 7 are drawings showing the vertical movement of the hinge member 6. FIG. 5 is a schematic vertical cross-sectional view showing a state in which the ADF frame 7 is closed viewed from a side of the image scanning device 1. FIG. 6 is a schematic vertical cross-sectional view showing a state in which the ADF frame 7 is closed in case an error is generated in the hinge member 6 or the like viewed from the side of the image scanning device 1. FIG. 7 is a schematic vertical cross-sectional view showing a state in which the ADF frame 7 is closed in case an error is generated in the hinge member 6 or the like viewed from the rear side of the image scanning device 1. In the present embodiment, an allowable error with respect to the error generated in the hinge member 6 or the like is set at d. That is, under a state in which the ADF cover 7 is closed and the three protrusions 23 provided on the bottom surface 7*a* are making contacts with the upper surface 5*a* of the device main body 5, as shown in FIG. 5, a gap of d/2 is respectively generated between the mounting plate 35 and the bottom part of the mounting concave 25, and between the mounting plate 35 and the upper end surface of the bosses 27. Accordingly, the mounting plate 35 is allowed to rattle in the gap for d/2 upward and d/3 downward. Therefore, even in case the error is generated in the hinge member 6 or the like, as shown in FIG. 6, the mounting plate 35 slightly moves vertically so as to absorb the error. Accordingly, the ADF frame 7 can be closed with the three protrusions 23 making contacts with the upper surface 5*a* of the device main body 5. At this time, as shown in FIG. 7, the ADF frame 7 is positioned in a vertical direction at a total of three points A, B and C and held horizontally at a prescribed height from the device main body 5. At the points A and B, the protrusions 23 on the bottom surface 7*a* make contacts with the upper surface 5*a* of the device main body 5. At the point C, the protrusion 23 on the fixing plate 45 makes contact with the upper surface of the mounting plate 35. Of course, the vertical movement of the mounting plate 35 is not limited to the state shown in FIG. 5 through FIG. 7, and changes appropriately according to the error in the hinge member 6 or the like. Although details are not shown in the drawing, the ADF frame 7 is positioned in the horizontal direction at a total of three points, i.e., two points where the outer circumferential surface of each of the bosses 27 makes contact with the inner circumferential surface of each of the boss insertion holes 39 and one point where the outer circumferential surface of the positioning pin 29 makes contact with the inner circumferential surface of the positioning hole 30. Accordingly, the ADF frame 7 is prevented from being displaced sideways.

Figure 8:
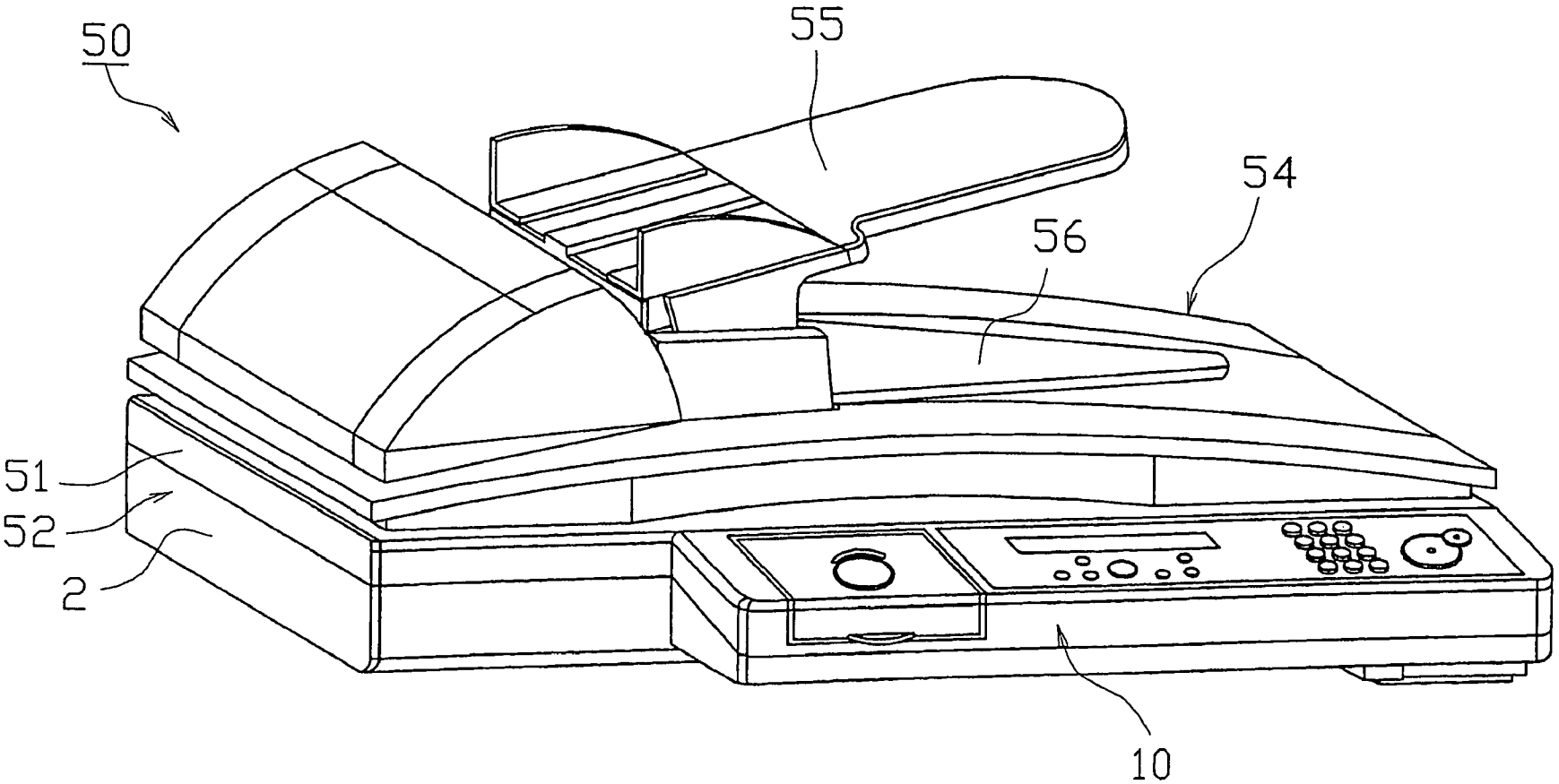
FIG. 8 is a schematic perspective view showing an exterior of an image scanning device according to another embodiment of the present invention.

In the following, a description will be made of a MFP type image scanning device 50 which includes both the FBS and the ADF and can carry out an image scanning process by both the flat bed method and the sheet through method. The bottom frame 2 and the scanner unit 12 of the image scanning device 50 shown in FIG. 8 are shared with the image scanning device 1. The image scanning device 50 includes a device main body 52, a document pressing plate 54 and the operation panel 10. The device main body 52 includes the bottom frame 2 and a frame cover 51 that covers the upper part of the bottom frame 2. The document pressing plate 54 is provided openable and closable on an upper surface of the device main body 52 via hinge members 53. On the document pressing plate 54, a document tray 55 and a document discharge tray 56 are provided. An original document to be scanned is set on the document tray 55. A scanned original document is discharged onto the document discharge tray 56.

Figure 10:
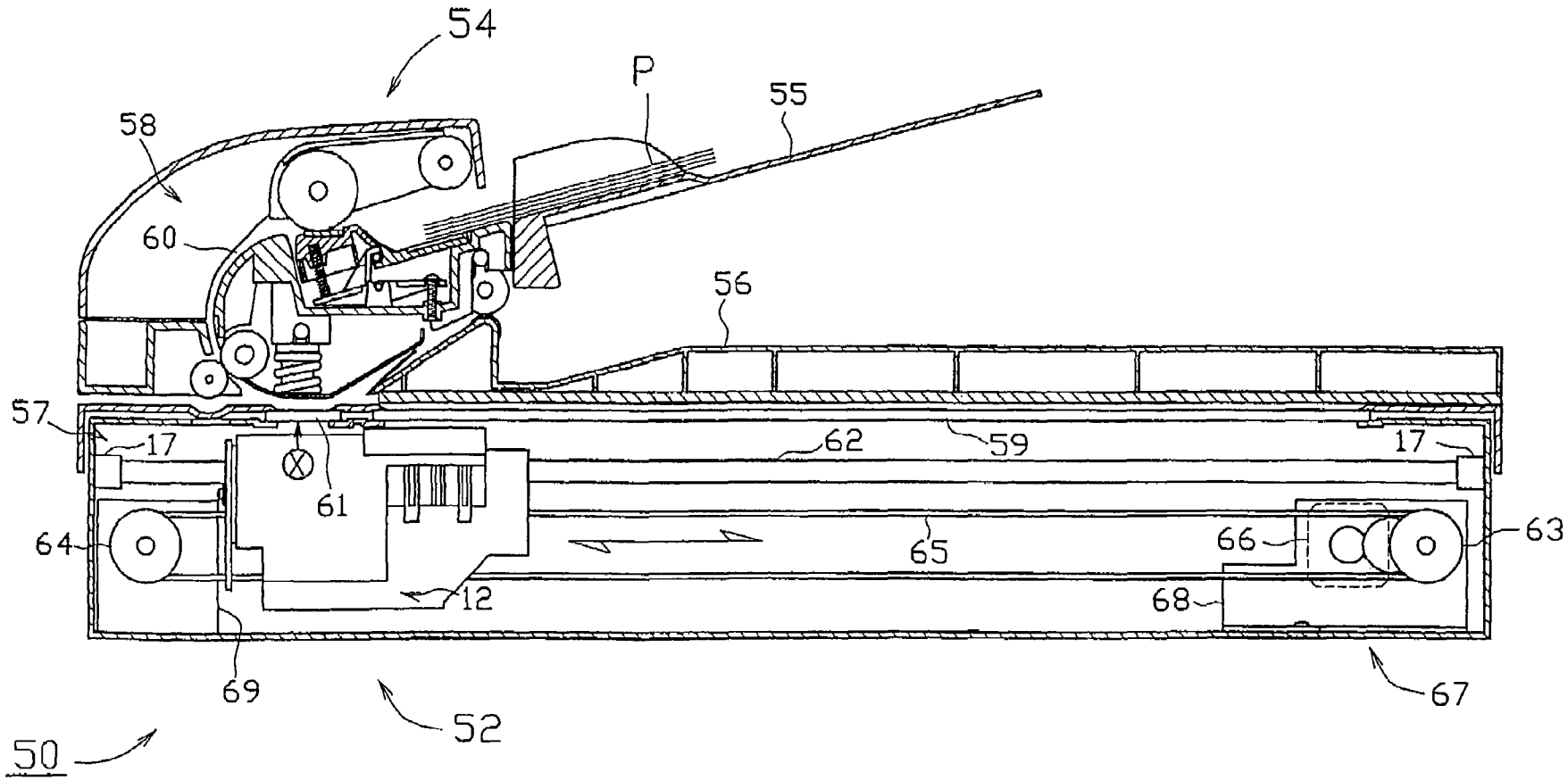
FIG. 10 is a schematic vertical cross-sectional view showing an inner structure of the image scanning device according to another embodiment of the present invention.

FIG. 10 is a schematic vertical cross-sectional view showing an inner structure of the image scanning device 50. As shown in the drawings, in the image scanning device 50, a FBS 57 is provided in the device main body 52 and an ADF 58 is provided in the document pressing plate 54. When carrying out an image scanning process by the FBS 57, an original document (not shown) is placed on a platen glass 59 provided on the upper surface of the device main body 52, and an image on a front surface of the original document is scanned by the scanner unit 12 disposed below the platen glass 59. Meanwhile, when carrying out an image scanning process by the ADF 58, a plurality of original documents P stacked on the document tray 55 is separated one sheet at a time from an uppermost sheet and fed into a transportation path 60. When an original document P passes the scanning position X, an image on a front surface of the original document P is scanned by the scanner unit 12 through a slit glass 61 provided adjacent to the platen glass 59. Then, the scanned original document P is discharged onto the document discharge tray 56. Further, the ADF 58 has the same structure as the ADF 11 of the image scanning device 1 and a detailed description of the ADF 58 will be omitted. The ADF 58 is an optional structure. The image scanning device 50 can be provided with only the FBS 57.

Figure 11:
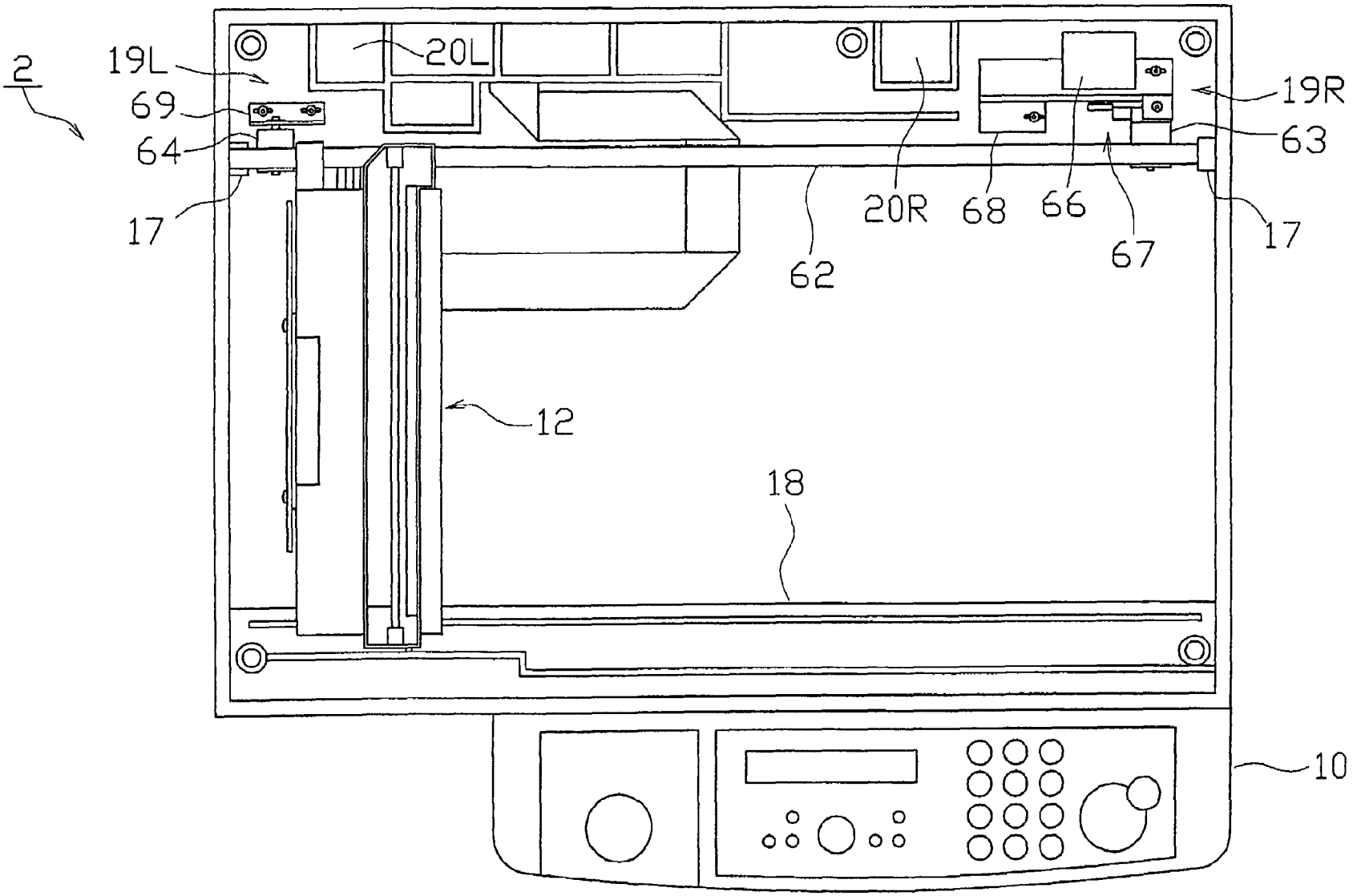
FIG. 11 is a schematic plan view showing an inner structure of a bottom frame according to another embodiment of the present invention.

In the image scanning device 50, to enable an image scanning process to be carried out by the scanner unit 12 under the flat bed method, the scanner unit 12 is provided capable of moving in parallel with the platen glass 59. FIG. 11 is a schematic plan view showing an inner structure of the bottom frame 2 in the image scanning device 50. As described above, the guide rod fixing parts 17, the guide rail 18 and the belt driving mechanism mounting parts 19L and 19R are provided in the bottom frame 2, respectively.

A guide rod 62 for regulating a scanning direction of the scanner unit 12 is fit and fixed in the guide rod fixing parts 17. A pair of the guide rod fixing parts 17 are provided at prescribed position on an inner surface of the bottom frame 2. The guide rod 62 is provided in the scanning direction and fixed by the guide rod fixing parts 17 at end parts of a back side of the scanner unit 12. The guide rod 62 is inserted through the scanner unit 12. Meanwhile, the guide rail 18 is provided along a side surface at the front side of the bottom frame 2 so as to be parallel with the guide rod 62. One end of the scanner unit 12 is placed on the guide rail 18 and the guide rod 62 is inserted through another end of the scanner unit 12. Accordingly, the scanner unit 12 can slide over the guide rail 18 while maintaining a horizontal state.

The belt driving mechanism mounting parts 19L and 19R are spaced for disposing a belt driving mechanism 67 which applies a driving force for moving the scanner unit 12. The belt driving mechanism 67 includes pulleys 63 and 64, a belt 65 and a motor 66 or the like. The motor 66 and the pulley 63 are fixed on the bracket 68 and the bracket 68 is fixed in the belt driving mechanism mounting part 19L by a screw or the like. The pulley 64 is fixed on a bracket 64 and the bracket 64 is fixed in the belt driving mechanism mounting part 19R by a screw or the like. As shown in FIG. 10 and FIG. 11, the belt 65 wound around the driving pulley 63 and the driven pulley 64 is configured to move by the rotation of the driving pulley 63 which rotates by a driving force from the motor 66. The belt 65 is fixed on the scanner unit 12. The driving pulley 63 and the belt 65 are respectively fixed on the bracket 68, disposed in the belt driving mechanism mounting part 19R provided in a right corner at the back side of the bottom frame 2, and fixed by a fixture such as a screw. Meanwhile, the driven pulley 64 is fixed on the bracket 69, disposed in the belt driving mechanism mounting part 19L provided in a left corner at the back side of the bottom frame 2, and fixed by a fixture such as a screw. The belt 65 is wound around the driving pulley 63 and the driven pulley 64. Accordingly, the belt 65 is tensioned along the guide rod 62. By controlling the motor 66, the scanning of the scanner unit 12 is controlled via the belt 65. As a result, when scanning an original document by the flat bed method, the scanner unit 12 can move below the platen glass 59.

Figure 9:
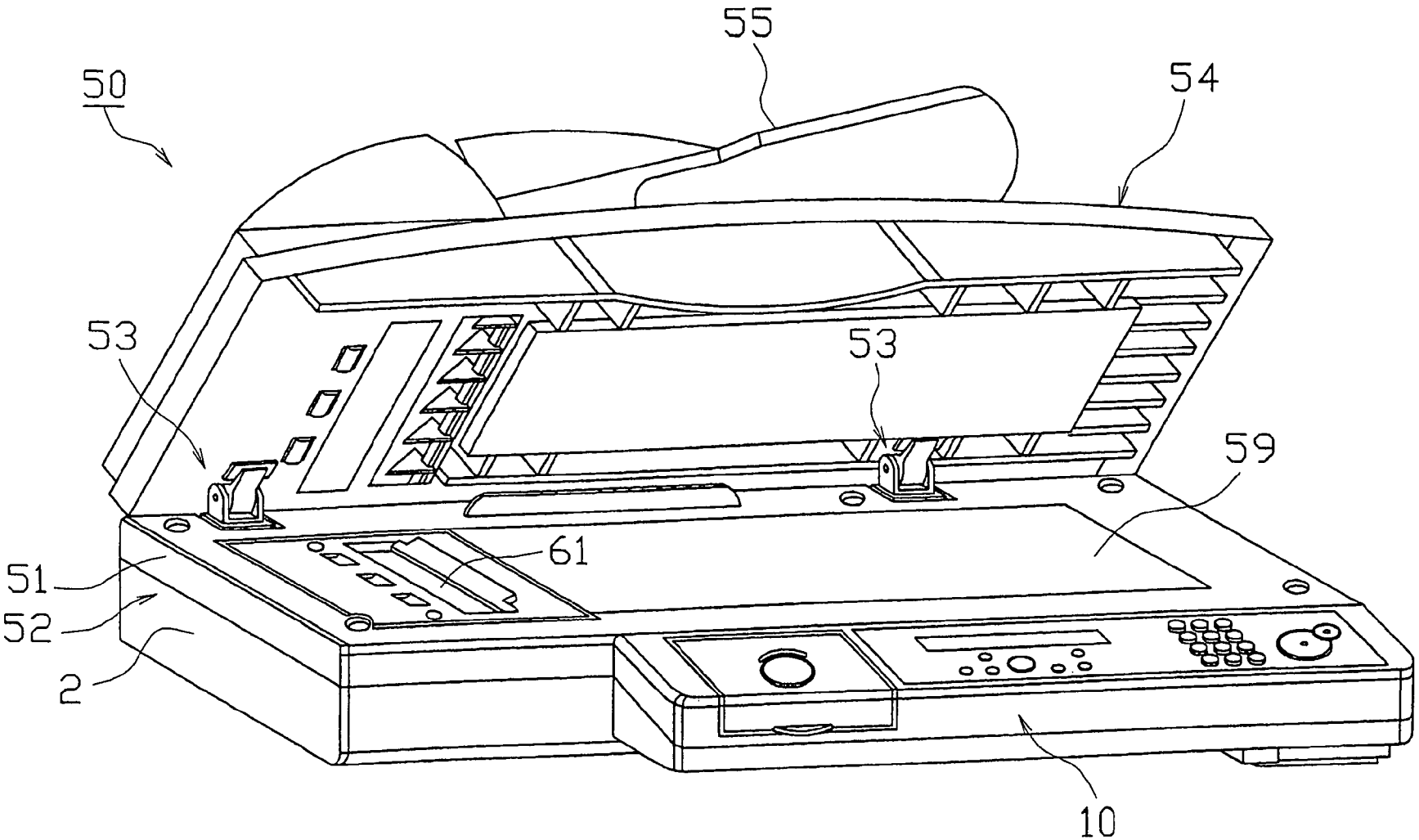
FIG. 9 is a schematic perspective view showing an exterior of the image scanning device according to another embodiment of the present invention.
Figure 12:
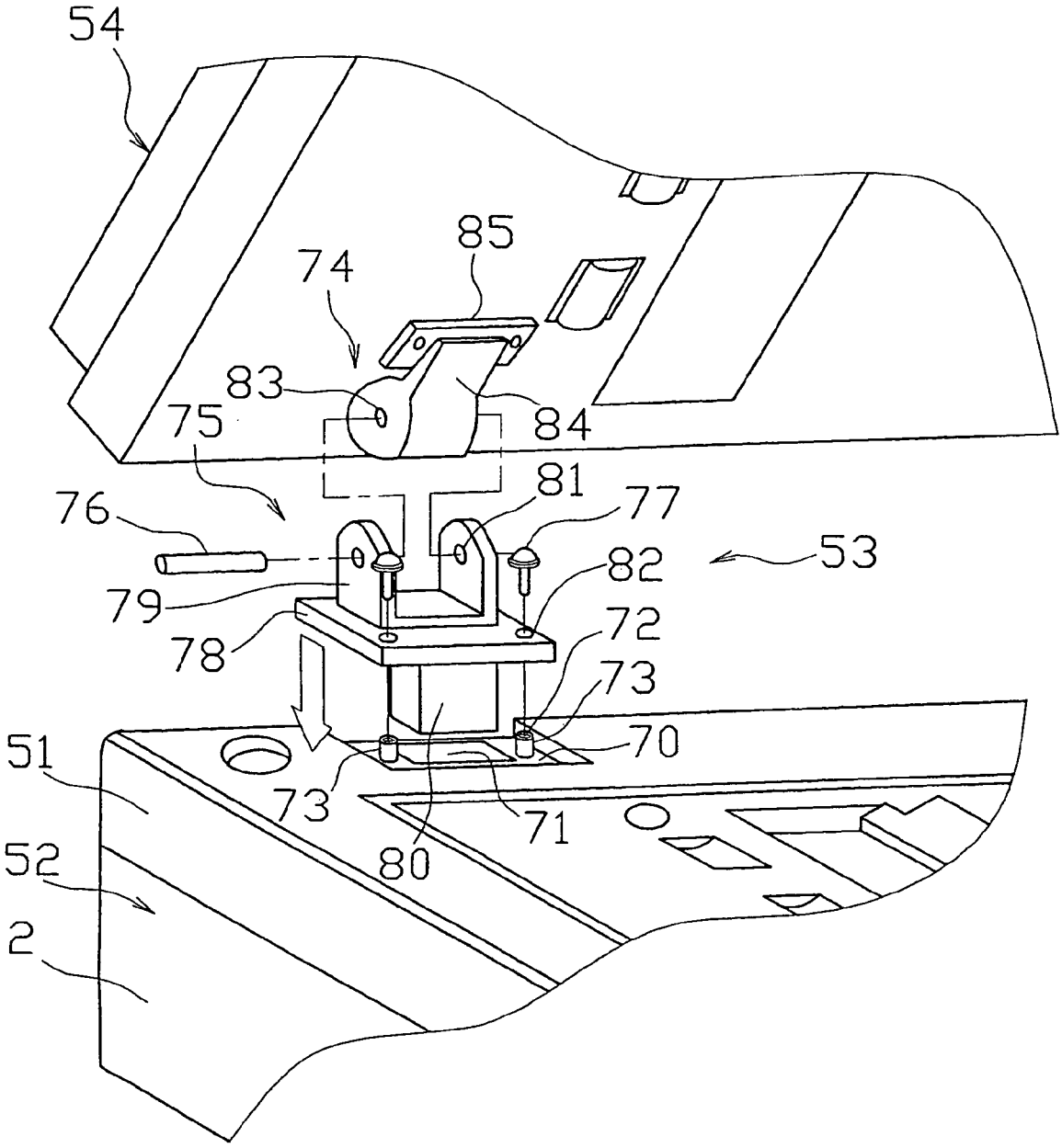
FIG. 12 is an enlarged exploded perspective view in proximity to one of the hinge members of FIG. 9 according to another embodiment of the present invention.
Figure 13:
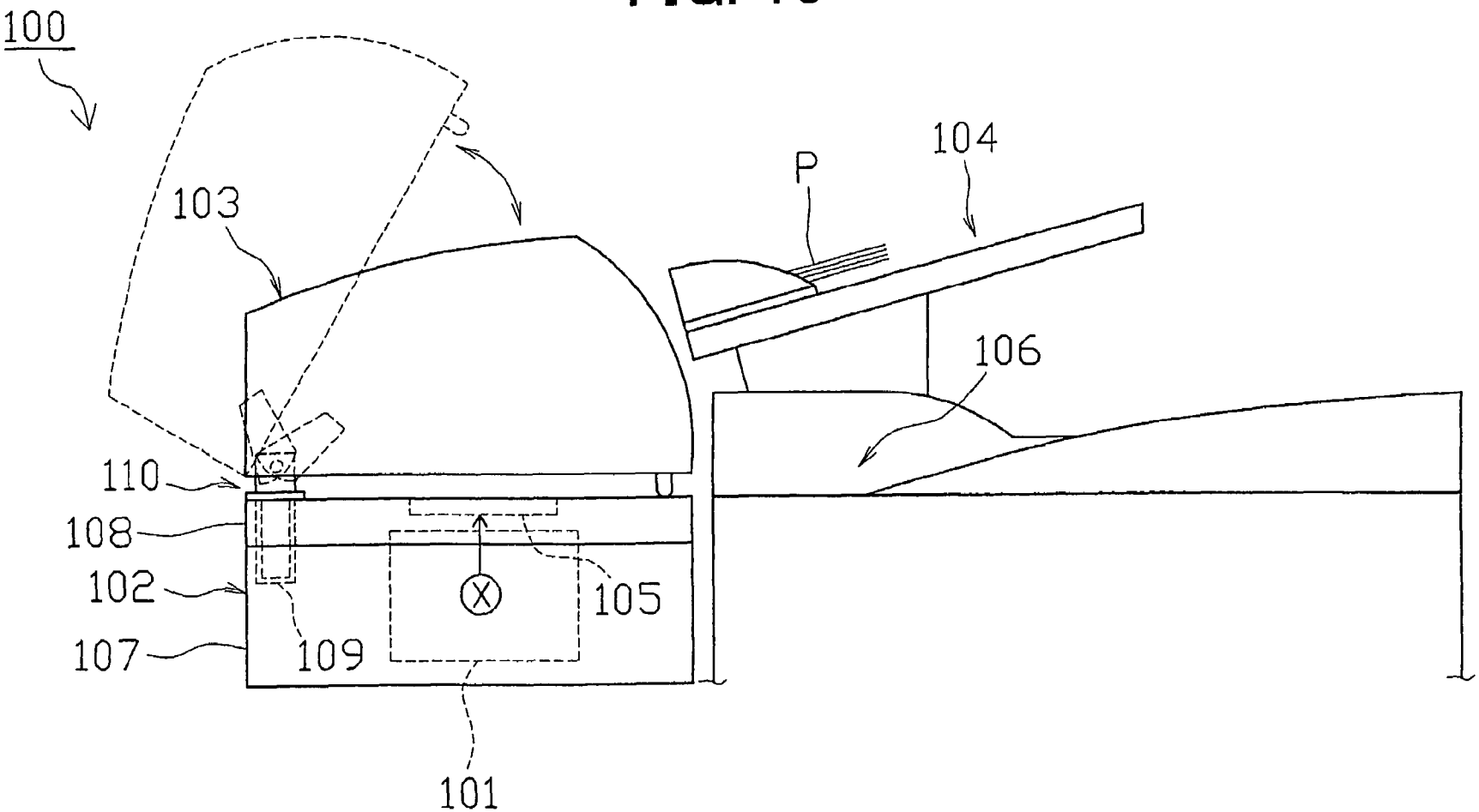
FIG. 13 is a schematic front view showing a conventional image scanning device.
Figure 14:
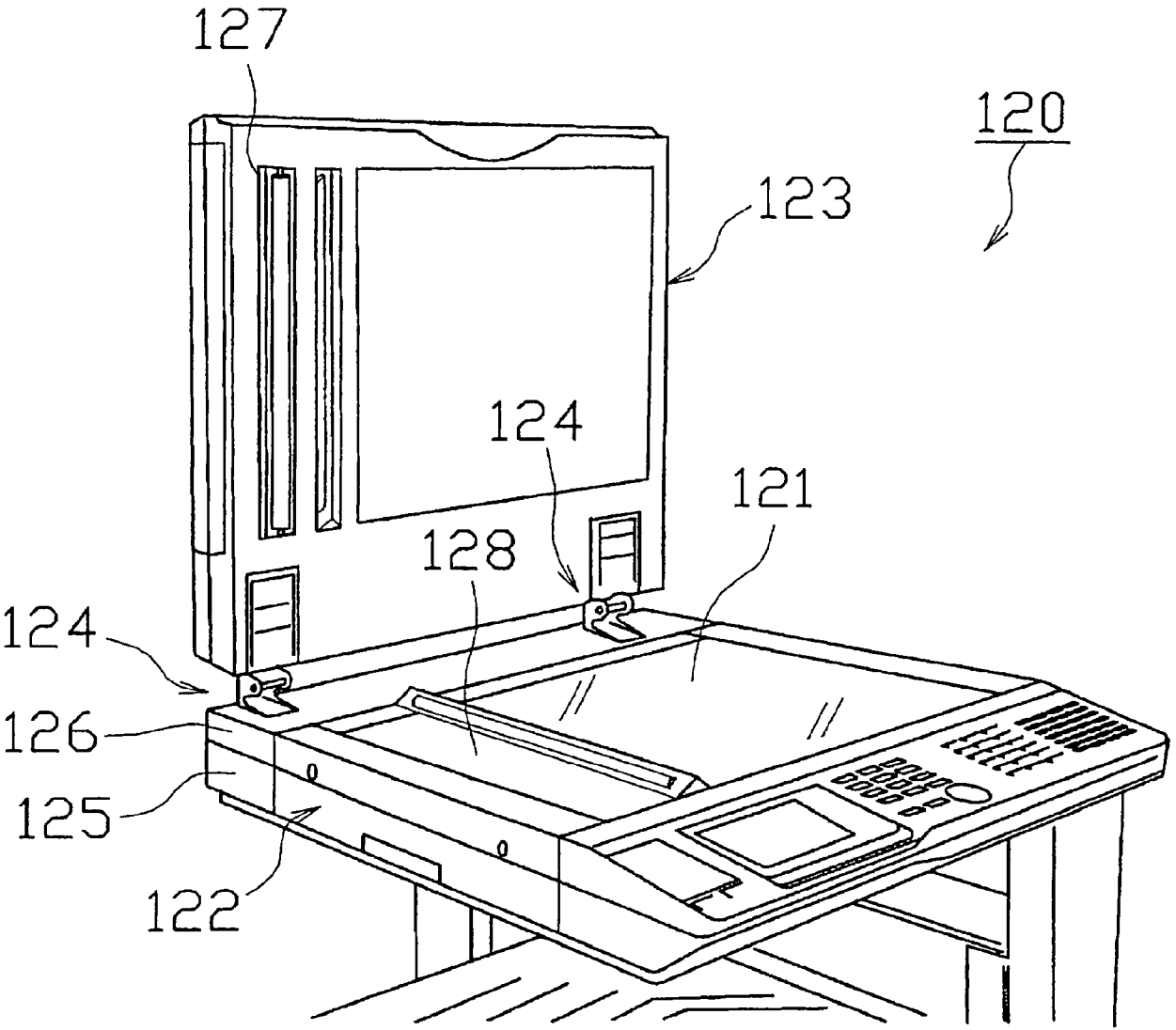
FIG. 14 is a schematic perspective view showing another conventional image scanning device.

As shown in FIG. 9, the document pressing plate 54 is fixed on the device main body 52 via the hinge members 53 at two positions on a rear side edge of the document pressing plate 54. The document pressing plate 54 can be opened forward, in other words, can be opened and closed in a manner that a bottom surface of the document pressing plate 54 is exposed to the front side of the device main body 52. FIG. 12 is an enlarged exploded perspective view in proximity to one of the hinge members 53 of FIG. 9. As shown in the drawing, a mounting concave 70, a through hole 71 and a pair of left and right bosses 73 are respectively provided on the rear side edge of the frame cover 51. The hinge member 53 is mounted on the mounting concave 70. The through hole 71 is formed on the bottom part of the mounting concave 70. One end part of the hinge member 53 is inserted into the device main body 52 through the through hole 71. The bosses 73 are provided protruding from both the left and the right sides of the through hole 71. A screw hole 72 is formed in each of the bosses 73.

The mounting concave 70 has a similar function as the mounting concave 25. However, as shown in FIG. 12, the shape of the mounting concave 70 is formed in accordance with the hinge member 53. In the same manner as the through hole 28, the through hole 71 is formed at a position corresponding to the insertion hole 20L of the bottom frame 2. The shape of the through hole 71 in a plan view is approximately the same as the shape of the insertion hole 20L. Accordingly, one end part of one of the hinge members 53 supporting the document pressing plate 54 is inserted through the through hole 71 and into the insertion hole 20L of the bottom frame 2. Further, although details are not shown in the drawing, on the mounting concave 70 where the other hinge member 53 is mounted, a through hole is formed at a position corresponding to the insertion hole 20R. One end part of the other hinge member 53 is inserted through the insertion hole and into the insertion hole 20R. The bosses 73 are inserted through the hinge member 53 and position the hinge member 53 with respect to the device main body 52. Fixing screws 77 to be described later are screwed together with the bosses 73.

As shown in FIG. 12, the hinge member 53 includes a frame supporting part 74 and a base part 75 which are mounted capable of swinging via a hinge pin 76. The frame supporting part 74 supports one end of the document pressing plate 54. The base part 75 is mounted onto the device main body 52. The base part 75 of the hinge member 53 is fixed on the upper surface of the frame cover 51 by the fixing screws 77.

The base part 75 includes a mounting plate 78, an approximately bracket-shaped hinge pin supporting portion 79 and an insertion portion 80. The mounting plate 78 is mounted on the upper surface of the frame cover 51. The hinge pin supporting portion 79 is provided on the upper surface of the mounting plate 78. The insertion portion 80 protrudes downward from a bottom surface of the mounting plate 78. The insertion portion 80 is inserted through the through hole 71 and into the device main body 52. A pair of pin insertion holes 81 are formed facing one another through the hinge pin supporting portion 79 for inserting the hinge pin 76. The hinge pin 76 is inserted through each of the pin insertion holes 81 and fixed. The insertion portion 80 is inserted through the through hole 71 of the frame cover 51 and into the insertion hole 20L of the bottom frame 2 to position the hinge member 53 with respect to the device main body 52. The transverse cross-sectional shape of the insertion portion 80 is approximately the same as the through hole 71 and the insertion hole 20L.

As shown in FIG. 12, the mounting plate 78 is a flat plate which is approximately rectangular in the plan view. A pair of boss insertion holes 82 are formed on the mounting plate 78 for inserting each of the bosses 73. The planar shape of the mounting plate 78 is approximately the same as the planar shape of the mounting concave 70. By fitting and mounting the mounting plate 78 in the mounting concave 70, the mounting plate 78 is prevented from being displaced in the horizontal direction. The thickness measurement of the mounting plate 78 is approximately the same as the depth measurement of the mounting concave 70. Therefore, when each of the bosses 73 is inserted into each of the boss insertion holes 82, an upper end surface of each of the bosses 73 does not protrude from the upper surface of the mounting plate 78.

As shown in FIG. 12, the fixing screw 77 includes a screw part and a screw head. The screw part is shorter than the depth of the screw hole 72 of the boss 73. The diameter of the screw head is formed larger than the diameter of the boss insertion hole 82. The fixing screw 77 is screwed together with the boss 73 inserted through the boss insertion hole 82. At this time, as described above, the upper end surface of each of the bosses 73 does not protrude from the upper surface of the mounting plate 78. Therefore, the screw head of the fixing screw 77 makes contact with the upper surface of the mounting plate 78 and the mounting plate 78 is fixed on the upper surface of the frame cover 51.

As shown in FIG. 12, the frame supporting part 74 includes an arm member 84 and a fixing plate 85. A pin insertion hole 83 is formed through an arc-shaped base end of the arm member 84 for inserting through the hinge pin 76. The fixing plate 85 is provided at a tip end of the arm member 84. The fixing plate 85 at the tip end of the frame supporting part 74 is fixed on the document pressing plate 54 by a screw or the like. The hinge pin 76 is inserted through the pin insertion hole 83 at the base end of the frame supporting part 74. Accordingly, the document pressing plate 54 can be swung with the hinge pin 76 as a swing center.

Further, in the image scanning device 50 of the above-described embodiment, the document pressing plate 54 is fixed on the upper surface of the device main body 52. However, the document pressing plate 54 can be mounted by using a member having a lift-up function as the hinge member 53, that is, a member which enables the hinge member 53 to move vertically with respect to the device main body 52. In this case, the document pressing plate 54 can be moved vertically while maintaining a horizontal state. Therefore, even when an original document is a booklet or the like having a thickness, the original document can be adhered onto the platen glass 59 evenly. As a result, a satisfactory image scanning process can be carried out by the scanner unit 12.

As described above, in the PPF type image scanning device 1 which carries out the image scanning process by the sheet through method, the rear side of the ADF frame 7 is supported by the hinge member 6 and the ADF frame 7 can be opened in a forward manner. Accordingly, when carrying out maintenance work of the image scanning device 1, the clothes of the user are not caught in the document tray 8 or the like. In addition, the maintenance work can be carried out easily regardless of which hand the user uses. Moreover, the bottom frame 2 is standardized for the image scanning device 1 and the MFP type image scanning device 50 which carries out an image scanning process by the flat bed method. Accordingly, the designing and the manufacturing of the bottom frame 2 can be standardized and the costs can be reduced.

The invention claimed is:

1. An image scanning device, comprising:

a device main body having means for scanning an image;

an Automatic Document Feeder (ADF) which feeds an original document from a document tray via a scanning position of the device main body to a document discharge tray;

an ADF frame accommodating the ADF; and a hinge member which supports a rear side of the device main body and the ADF frame in a manner that the ADF frame can be swung, wherein at least three protrusions are provided on the ADF frame and each protrusion makes contact with a corresponding concave recess in the upper surface of the device main body to carry out a positioning of the ADF frame in a height direction, at least two of the protrusions are provided on a side opposite to the side of the hinge member, and at least one of the protrusions is provided at a center of the hinge member side and is separate from the hinge member and does not contact the corresponding concave recess when the ADF frame is swung open, wherein a base part of the hinge member is mounted on the upper surface of the device main body in a manner capable of moving vertically within a prescribed range, and the at least one protrusion on the hinge member side makes contact with the corresponding concave recess in the base part of the hinge member.

2. The image scanning device according to claim 1, wherein the image scanning device carries out an image scanning process by a sheet through method, and the ADF frame is provided openable and closable so as to expose a bottom surface of the ADF frame to a front side.

3. The image scanning device according to claim 2, wherein the device main body comprises:

a bottom frame which is formed as a hollow housing having an opening at an upper part;

a frame cover which covers the upper part of the bottom frame; and a supporting part formed in the bottom frame into which the hinge member is inserted so that, in case of using the bottom frame to carry out an image scanning process by a flat bed method, the hinge member supports a document pressing plate to be openable and closable on an upper surface of the device main body.

4. The image scanning device according to claim 1, wherein a positioning hole is provided on the bottom surface of the ADF frame, a positioning pin is provided protruding from the upper surface of the device main body to carry out a positioning in a horizontal direction, and the positioning pin fits into the positioning hole.

5. The image scanning device according to claim 4, wherein the ADF frame is a resin frame formed as a hollow housing.

6. The image scanning device according to claim 4, wherein the positioning pin and the positioning hole are provided at a position located away from a position where the ADF frame and the device main body are mounted.

7. The image scanning device according to claim 1, wherein a protruding length of each of the protrusions is the same.

8. The image scanning device according to claim 7, wherein at least one of the protrusions is formed with a magnet, and a steel plate is disposed on a bottom part of a concave recess corresponding to the at least one of the protrusions.

9. The image scanning device according to claim 1, wherein the base part of the hinge member is mounted on the upper surface of the device main body via a regulatory screw in a manner capable of moving vertically within a prescribed range.

10. The image scanning device according to claim 1, wherein the at least one of the protrusions on the hinge member side is provided on a swung portion of the ADF frame.

11. A method for manufacturing an image scanning device, comprising:

forming a device main body with a means for scanning an image;

feeding an original document from a document tray via a scanning position of the device main body to a document discharge tray by an Automatic Document Feeder (ADF);

accommodating the ADF with an ADF frame;

supporting a rear side of the device main body and the ADF frame with a hinge member in a manner that the ADF frame can be swung; and forming at least three protrusions on the ADF frame and each protrusion contacting a corresponding concave recess in the upper surface of the device main body to carry out a positioning of the ADF frame in a height direction, wherein at least two of the protrusions are provided on a side opposite to the side of the hinge member, and at least one of the protrusions is provided at a center of the hinge member side and is separate from the hinge member and does not contact the corresponding concave recess when the ADF frame is swung open, wherein a base part of the hinge member is mounted on the upper surface of the device main body in a manner capable of moving vertically within a prescribed range, and the at least one protrusion on the hinge member side makes contact with the corresponding concave recess in the base part of the hinge member.

12. The method for manufacturing an image forming device according to claim 11, further comprising carrying out an image scanning process by a sheet through method and providing the ADF frame openable and closable so as to expose a bottom surface of the ADF frame to a front side.

13. The method for manufacturing an image forming device according to claim 11, wherein the at least one of the protrusions on the hinge member side is provided on a swung portion of the ADF frame.

* * * * *